US005410318A

United States Patent [19]

Wong et al.

[11] Patent Number: 5,410,318

[45] Date of Patent: Apr. 25, 1995

[54] SIMPLIFIED WIDE-BAND AUTOTRACK TRAVELING WAVE COUPLER

[75] Inventors: William C. Wong, Palos Verdes Estates; Youn H. Choung, Rolling Hills Estates; Ming-Jong Shiau, Cerritos; Chun-Hong H. Chen, Torrance, all of Calif.

[73] Assignee: TRW Inc., Redondo Beach, Calif.

[21] Appl. No.: 218,775

[22] Filed: Mar. 25, 1994

[51] Int. Cl.[6] ..... H01Q 3/00; H01P 1/16; H01P 5/18

[52] U.S. Cl. ..... 342/359; 333/113; 333/21 R; 342/363

[58] Field of Search ..... 333/113, 21 R; 342/359, 342/363

[56] References Cited

U.S. PATENT DOCUMENTS

| | | | |
|---|---|---|---|
| 2,748,350 | 5/1956 | Miller | 333/113 |
| 3,529,205 | 9/1970 | Miller | 333/113 X |
| 3,936,838 | 2/1976 | Foldes | 333/113 X |
| 4,367,446 | 1/1983 | Hall | 333/21 R X |
| 4,420,756 | 12/1983 | Hamada et al. | 333/122 X |
| 4,566,012 | 1/1986 | Choung et al. | 333/113 X |

FOREIGN PATENT DOCUMENTS

| | | | |
|---|---|---|---|
| 210701 | 9/1986 | Japan | 333/113 |

OTHER PUBLICATIONS

Shiau, M. J. et al., "NASA Acts Autotrack Antenna Feed System," *IEEE AP/S Symposium Digest*, pp. 83–86 (Jun. 1986).

Choung, Youn H. et al., "Theory and Design of a *Ku*–Band $TE_{21}$–Mode Coupler," *IEEE Transactions on Microwave Theory and Techniques*, Abstract, vol. 30, No. 11, pp. 1862–1866 (Nov. 1982).

*Primary Examiner*—Paul Gensler

[57] ABSTRACT

In accordance with the present invention, a traveling wave coupler generates tracking signals from a circularly polarized microwave signal and includes a waveguide manifold for exciting circular $TM_{01}$ and $TM_{11}$ modes of said circularly polarized microwave signal. The waveguide manifold includes an input port, a propagation length, and an output port. A coupling arm waveguide includes an auxiliary input port and an auxiliary output port and is aligned and connected to the waveguide manifold along a portion of the propagation length. A coupler located between the waveguide manifold and the coupling arm transforms microwave energy of a $TM_{01}$ mode of the circularly polarized microwave signal into a rectangular $TE_{10}$ mode in the coupling arm waveguide. The coupling arm waveguide and the coupler generate a difference signal, used to generate the tracking signals, at the auxiliary output port related to the coupled $TE_{10}$ mode.

17 Claims, 3 Drawing Sheets

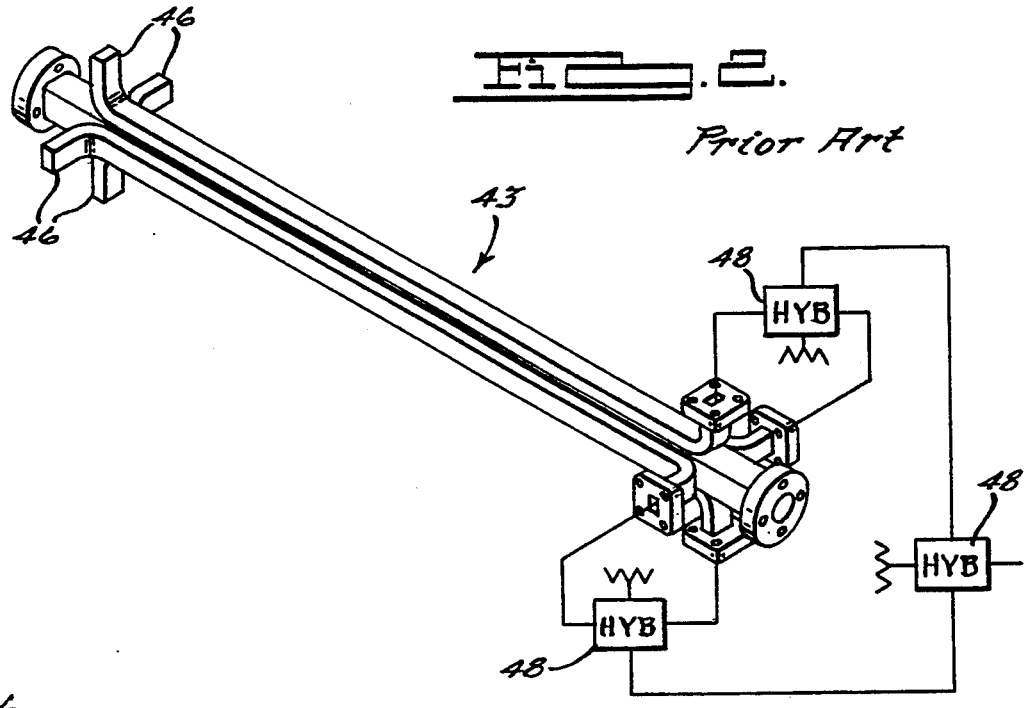
FIG. 2.
Prior Art
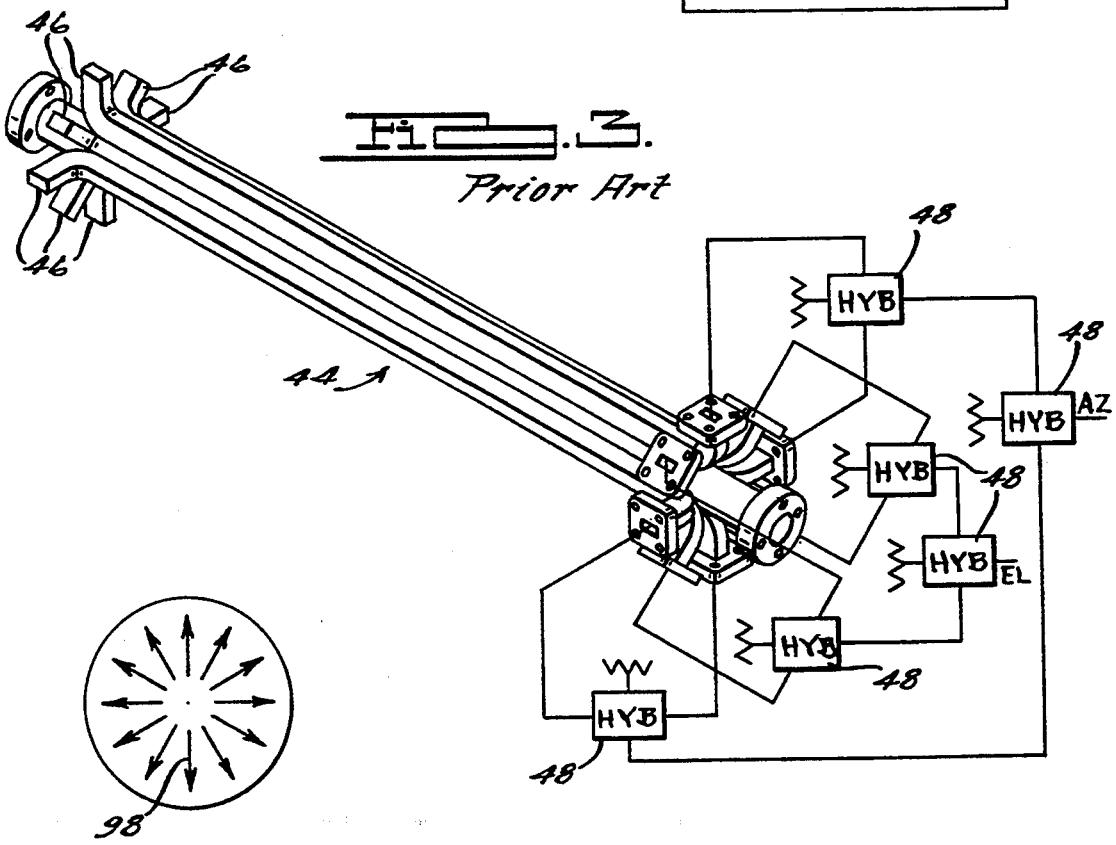
FIG. 3.
Prior Art
FIG. 5.

SIMPLIFIED WIDE-BAND AUTOTRACK TRAVELING WAVE COUPLER

BACKGROUND OF THE INVENTION

1. Technical Field

This invention relates to antenna tracking feed systems, and more particularly, to a traveling wave coupler used in conjunction with a multimode feed horn. 2. Background Crosslink and downlink point-to-point satellite communications require narrow beamwidth to obtain high antenna gain. In order to maintain reliable communications, a satellite antenna must be pointed accurately towards a signal source. To achieve accurate pointing, satellites commonly employ autotracking systems to provide tracking signals related to pointing errors in elevation and azimuth. The tracking signals control a feedback servoloop of the satellite to orient the satellite as required to position the antenna accurately towards the signal source.

Conventional satellite autotracking systems utilize a monopulse-tracking configuration in which a plurality of antennas, feeding a reflector system, develop three tracking signals, namely an azimuth error signal, an elevation error signal, and a sum signal, which are related to pointing accuracy of the satellite antenna. Monopulse tracking systems are well-known and are described in *Radar Handbook* by M. I. Skolnik, Second Edition, McGraw-Hill (1990), hereby incorporated by reference.

Conventional autotracking systems use a single multimode feedhorn in conjunction with a mode coupler. The multimode feedhorn is designed to support multiple circular waveguide modes. A fundamental circular $TE_{11}$ mode carries a sum radiation pattern used to generate a sum signal and higher order modes, such as $TM_{01}$, $TE_{21}$ and $TE_{01}$, carry a difference radiation pattern used to generate error signals. The mode coupler separates the higher modes from the fundamental modes and thus separate sum and error signals.

The mode coupler used in the conventional single horn tracking system can be an E-plane folded magic tee (MT), a turnstile junction (TJ), or a traveling wave coupler (TWC). The MT approach is a relatively simple way to extract $TM_{01}$ mode. The MT approach, however, can not be used for tracking a circularly polarized source because the sum channel responds to linearly polarized signals only. The TJ approach can be used for tracking a circularly polarized source. However, the TJ has complex construction and a large cross-section. Most importantly, the TJ has relatively narrow bandwidth, usually less than 2%. Consequently, the TJ's require tight (high cost) manufacturing tolerance and are sensitive to environmental changes.

The TWC is the only viable approach for wideband operation with circularly polarized fields. Conventional TWCs typically include four or eight arms depending upon whether the source is linearly or circularly polarized, respectively. Each of the coupling arms of the prior art TWC must be balanced to provide an accurate error signal. Amplitude or phase imbalance between coupling arms leads to higher autotracking errors and thus poor aperture efficiency, because any imbalance will result in a null shift in the difference pattern, causing the peak of the sum pattern to be misaligned with the null of the difference pattern. In addition, the multiple arms significantly increase weight of the feed system particularly when the signal source is circularly polarized.

Thus, it would be desirable to provide a TWC at lower cost by simplifying the TWC construction and by reducing or eliminating the need for balancing multiple arms. Further, it would be desirable to provide enhanced performance of a tracking system by eliminating any possible amplitude and phase imbalance. Furthermore, it would be desirable to provide fewer coupling arms in order to make the TWC more compact in the transverse direction to reduce mechanical interference with other mechanical structures, to decrease weight thereof, to simplify the structure and reduce the construction cost.

SUMMARY OF THE INVENTION

In accordance with the present invention, a traveling wave coupler generates tracking signals from a circularly polarized microwave signal and includes a circular waveguide manifold for exciting $TM_{01}$ and $TE_{11}$ circular waveguide modes of said circularly polarized microwave signal. The waveguide manifold includes an input port, a propagation length, and an output port. A single coupling arm rectangular waveguide includes an auxiliary input port and an auxiliary output port and is aligned and connected to the waveguide manifold along a portion of the propagation length. A coupler located between the waveguide manifold and the coupling arm transforms microwave energy of said circular waveguide $TM_{01}$ mode into a rectangular waveguide mode $TE_{10}$. The coupling arm waveguide and the coupler generate a difference signal, used to generate the tracking signals, at the auxiliary output port related to the coupled $TE_{10}$ mode.

Other objects, features and advantages will be readily apparent.

BRIEF DESCRIPTION OF THE DRAWINGS

The various advantages of the present invention will become apparent to those skilled in the art after studying the following specification and by reference to the drawings in which:

FIG. 2 is a perspective view of a first travelling wave coupler including four coupling arms according to the prior art;

FIG. 3 is a perspective view of a second travelling wave coupler including eight coupling arms according to the prior art;

FIG. 5 is a mode diagram of a $TM_{01}$ mode in a circular wave guide;

DESCRIPTION OF THE PREFERRED EMBODIMENT

Figure 1:
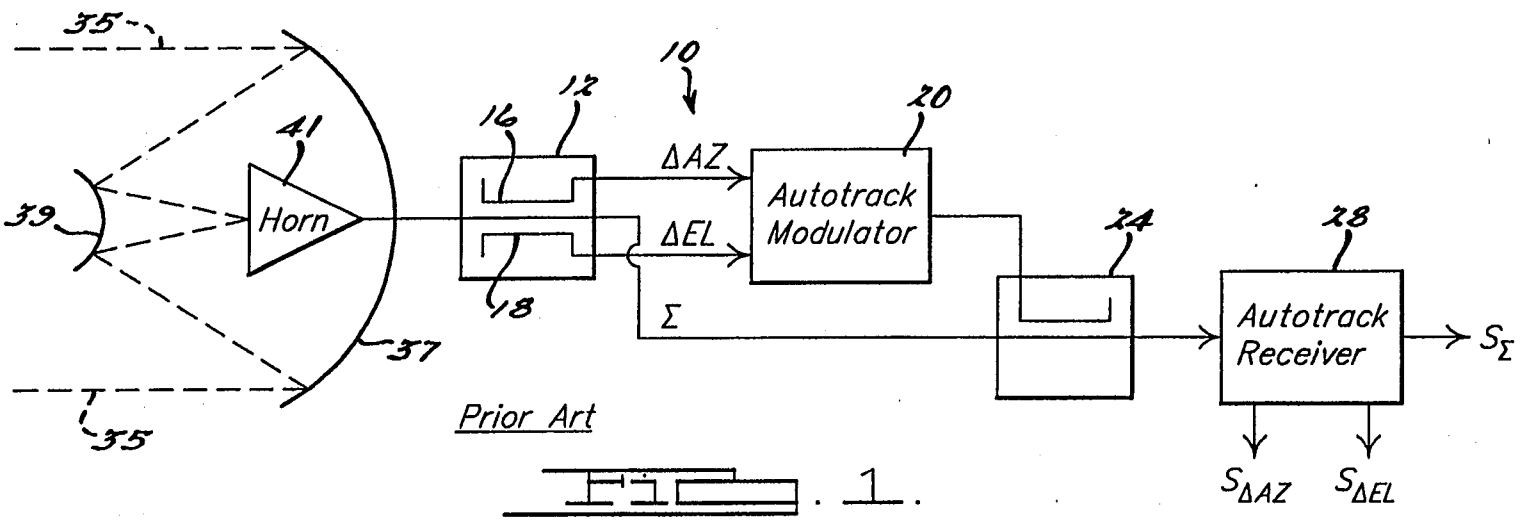
Prior Art FIG. 1.
FIG. 1 is a schematic diagram of an autotracking system according to the prior art.

A schematic diagram of an autotracking system 10 according to the prior art for tracking a signal source is shown in FIG. 1 and includes a mode coupler 12 with a plurality of coupling arms 16 and 18 (up to six additional coupling arms are conventionally used but are not shown), an autotrack modulator 20, a directional coupler 24, and an autotrack receiver 28. The mode coupler 12 can be a turnstile junction, an E-plane magic tee or a traveling wave coupler. A far field microwave signal 35 is focused by a reflector network 37 and 39 and collimated into a multimode feed horn 41 which can support higher order waveguide modes in addition to the fundamental sum mode. The mode coupler 12 couples the difference modes without significantly disturbing the sum mode (Σ). The difference mode includes an azimuth tracking component (ΔAZ) and an elevation tracking component (ΔEL) which are extracted by at least two physically separate arms 16 and 18. The difference modes carry the RF error signals while the sum mode carries the RF sum signal.

The autotrack modulator 20 time-multiplexes azimuth and elevation error signals $V_{\Delta AZ}$ and $V_{\Delta EL}$. The directional coupler 24 amplitude modulates the sum signal using the time-multiplexed error signals to generate a composite RF signal. The autotrack receiver 28 demodulates and downconverts the composite RF signal and generates IF azimuth and elevation servo signals $S_{\Delta AZ}$ and $S_{\Delta EL}$ which are fed back to the autotracking servoloop to correct mispointing.

The IF servo signal strengths are as follows:

$$S_{AZ}\,\alpha\,(V_{\Delta AZ}/V_{\Sigma})\times COS\,\Phi_{AZ} \quad (1)$$

$$S_{EL}\,\alpha\,(V_{\Delta EL}/V_{\Sigma})\times COS\,\Phi_{EL} \quad (2)$$

where $V_{\Delta AZ}$ is the azimuth RF error signal voltage; $V_{\Delta EL}$ is the elevation RF error signal voltage; $V_{\Sigma}$ is the RF sum signal voltage; $\Phi_{AZ}$ is the phase difference between the azimuth error and the sum signals; and $\Phi_{EL}$ is the phase difference between the elevation error and the sum signals. Because of the phase terms, the error and the sum RF signals must be tuned 0° in phase or 180° out of phase in hardware implementations. If the sum and the error RF signals are in phase quadrature (i.e. 90° or 270° out of phase), there will be no IF servo signals because the cosine term is zero.

As described above, each of the conventional couplers have drawbacks when used for a circularly polarized source. While relatively simple, the E-plane folded magic tee cannot autotrack circularly polarized signals because the sum channel only responds to linearly polarized sources. The turnstile junction approach responds to circularly polarized sources, but has complex construction and a large cross-section. Most importantly, the turnstile junction has relatively narrow bandwidth, usually 2% or less. Turnstile junctions require tight (high cost) manufacturing tolerances and are sensitive to environmental changes.

Referring to FIGS. 2 and 3, traveling wave couplers 43 and 44, according to the prior art, typically include four (FIG. 2) or eight (FIG. 3) arms 46 depending upon whether the source is linearly or circularly polarized. Each of the coupling arms 46 of the prior art traveling wave couplers 43 and 44 must be balanced to provide an accurate signal which lacks residual imbalance. In other words, each coupling arm 46 must generate a signal having phase and amplitude consistent with the phase and amplitude of other coupling arms in traveling wave coupler 12 in FIG. 1. In addition, prior art traveling wave couplers 43 and 44 require many hybrid circuits 48.

Figure 4:
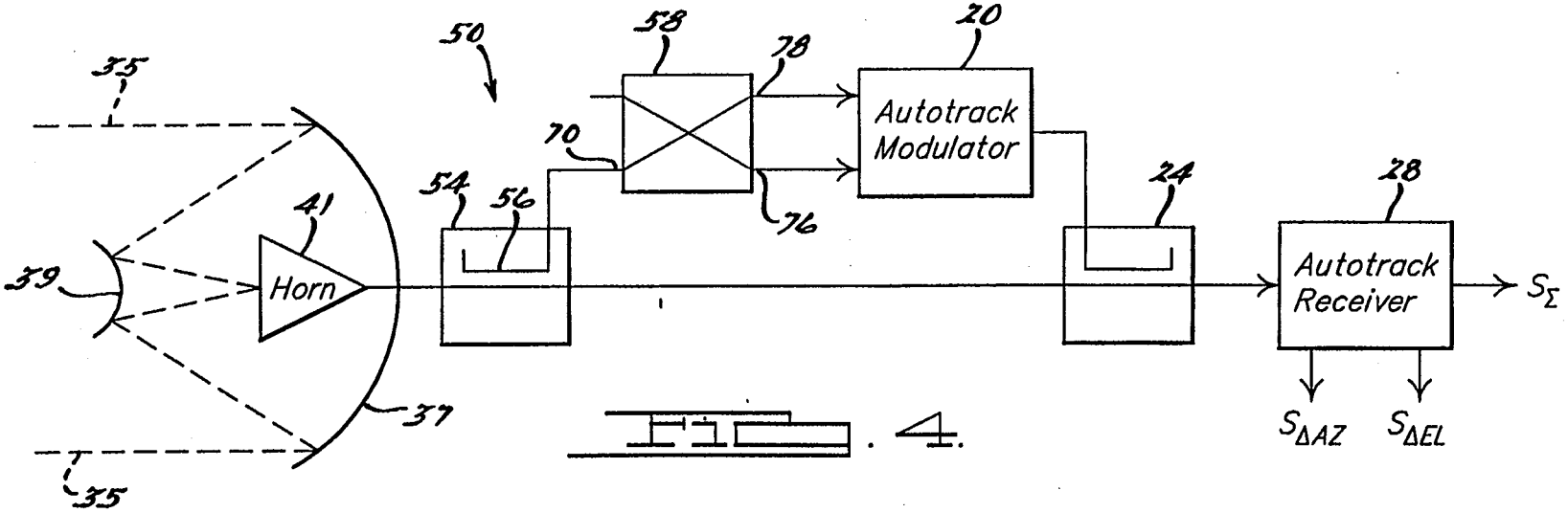
FIG. 4 is a schematic diagram of an autotracking system incorporating a traveling wave coupler according to the present invention.
Figure 6:
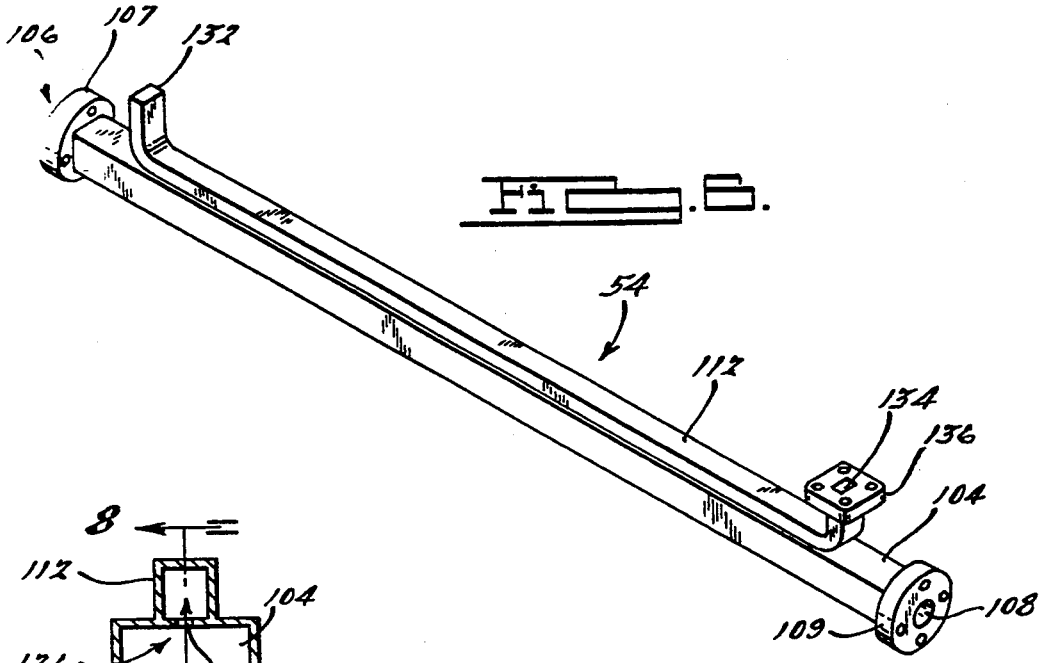
FIG. 6 is a perspective view of a traveling wave coupler according to the present invention and including one coupling arm.
Figure 7:
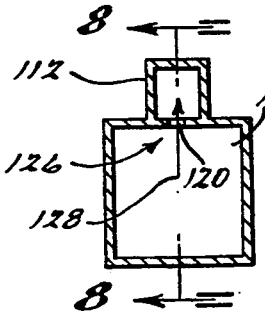
FIG. 7 is a cross-sectional view of the traveling wave coupler of FIG. 6 taken along line 7—7 in FIG. 8.

In FIG. 4, an autotracking system 50 according to the present invention for tracking a circularly polarized source is shown. For purposes of clarity, reference numerals from FIG. 1 are used in FIG. 4 where appropriate. The autotracking system 50 includes a traveling wave coupler 54 with a single coupling arm 56 used to extract RF signals of the $TM_{01}$ mode. A 90° hybrid 58 is connected to the coupling arm 56 of the traveling wave coupler 54. An autotrack modulator 20 time-multiplexes both outputs of the 90° hybrid 58. The remaining elements of the autotracking system 50 parallel the prior art autotracking system of FIG. 1.

Circularly polarized signals include a vertically polarized (VP) component and a horizontally polarized (HP) component in phase quadrature. In other words, the (VP) component is leading or lagging the HP component by 90 degrees depending upon whether the (CP) source is left or right handed, respectively. Electric field lines 98 of the $TM_{01}$ mode are illustrated in FIG. 5. The composite RF error signals carried by the $TM_{01}$ mode in response to a CP source and extracted by the mode coupler 54 into the side arm 56 is therefore the vector sum of the elevation and the azimuth errors, separated by 90° phase, i.e., in mathematical form, $$V_{\Delta} = \frac{1}{\sqrt{2}}\,(V_{\Delta AZ} + e^{-j} \times V_{\Delta EL}) \quad (3)$$

The 90° hybrid 58 splits $V_{\Delta}$ equally between its two output ports 76 and 78 with 90° phase differences, i.e.

$$S_{H1} \sim V_{H1} = \frac{1}{2}\,(V_{\Delta AZ} + e^{-j} \times V_{\Delta EL}) \quad (4)$$

$$S_{H2} \sim V_{H2} = \frac{1}{2}\,(V_{\Delta EL} + e^{j} \times V_{\Delta AZ}) \quad (5)$$

If $V_{H1}$ is phase-matched to $V_{\Sigma}$, the corresponding IF servo signal $S_{H1}$ will be proportional to $V_{\Delta AZ}$ only since the second term in Eq. (4) is 90° out-of-phase with respect to $V_{\Sigma}$. While $V_{H1}$ is phase-matched to $V_{\Sigma}$, $V_{H2}$ is automatically phase-matched to $V_{\Sigma}$. IF servo signal $S_{H2}$, corresponding to $V_{H2}$, is therefore also proportional to $V_{\Delta EL}$ only. The autotracking system 50 according to the present invention therefore obtains both azimuth and elevation servo signals with only one coupling arm 56 when the incoming signal is circularly polarized.

Referring to FIGS. 6–9, the traveling wave coupler 54 for CP sources according to the present invention is shown in greater detail and includes a waveguide manifold 104 having an input port 106 adjacent a flange 107 for connection to the multimode horn 41 and an output port 108 adjacent a flange 109 for connection to the directional coupler 24. The traveling wave coupler 54 includes one coupling arm 112 connected to an outer surface of the waveguide manifold 104. The waveguide manifold 104 is sized to support both the circular $TE_{11}$ and $TM_{01}$ modes. The coupling arm 112 is dimensioned to support only the fundamental rectangular $TE_{10}$ mode. The waveguide manifold 104 has a circular cross-section while the coupling arm 112 has a rectangular cross-section. The coupling arm 112 is also sized to ensure that the phase velocity of the $TE_{10}$ mode in the coupling arm 112 is the same as the phase velocity of the $TM_{01}$ mode in the waveguide manifold 104. Microwave energy of the $TM_{01}$ mode in the circular waveguide is easily transformed into the rectangular $TE_{10}$ mode in the coupling arm 112 due to the phase velocities of the rectangular $TE_{10}$ and the circular $TM_{01}$ being the same. Microwave energy of the circular $TE_{11}$ mode is not easily transformed into the rectangular $TE_{10}$ mode due to different phase velocities of the circular $TE_{11}$ mode and the rectangular $TE_{10}$ mode.

The traveling wave coupler 54 includes orifices 120 provided in a common wall 124 shared by the coupling arm 112 and the waveguide manifold 104. Orifices 120 in common wall 124 define a coupling region 126. Specifically, microwave energy transferred in the $TM_{01}$ mode in the circular waveguide manifold is coupled into the coupling arm 112 because its phase velocity is identical to that of the $TE_{10}$ mode in the coupling arm 112. On the other land, the orifices 120 cause negligible effects on the $TE_{11}$ mode if the orifice size is not excessively large. The microwave energy transferred in the $TE_{11}$ mode therefore passes through the coupling region 126 with little leakage into the coupling arm 112.

An approximate relative distribution energy is indicated by the relative length of vectors 128. In other words, maximum energy transfer occurs through orifices 120 centered between the input port 106 and the output port 108. Minimum energy transfer occurs through orifices 120 located adjacent the input and output ports 106 and 108.

The coupling arm 112 includes input and output ports 132 and 134. The input port 132 terminates in matched load, i.e. the characteristic impedance of the coupling arm 112. The coupling arm 112 includes a connecting flange 136 adjacent the output port 134.

Figure 8:
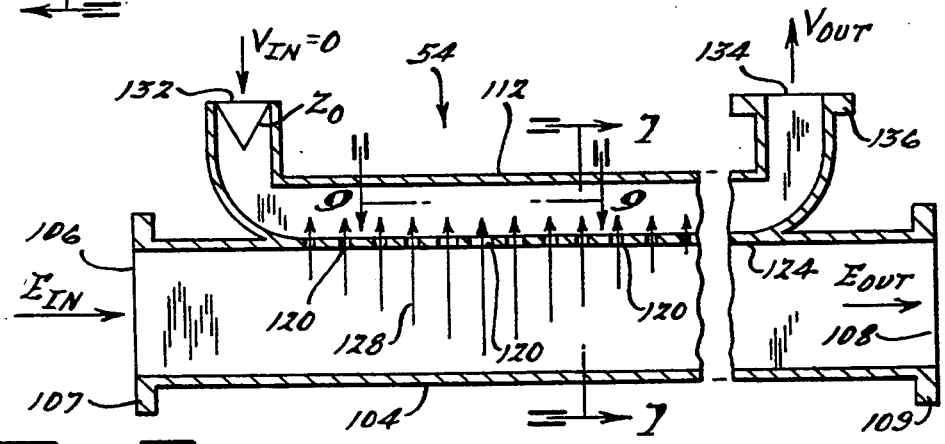
FIG. 8 is a cross-sectional view of the traveling wave coupler of FIG. 6 taken along line 8—8 of FIG. 7.
Figure 9:
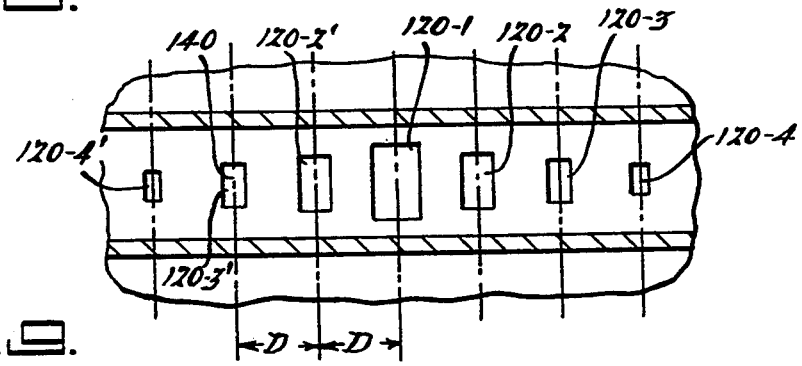
FIG. 9 is a cross-sectional view showing orifices of the traveling wave coupler of FIG. 3 and taken along line 9—9 in FIG. 8.

Referring to FIG. 8, orifices 120 defining the coupling region 126 are shown in greater detail. The orifices 120 shown in FIG. 9 are rectangular in shape although other shapes, such as circular or elliptical, are also acceptable. Center points 140 of adjacent orifices are preferably equally spaced a distance "D". The rectangular orifices preferably decrease in size from a center orifice 120-1. In other words, the orifices 120-2 and 120-2' are smaller than orifice 120-1, the orifices 120-3 are smaller than 120-2, . . . , and the orifices 120-N are smaller than the orifices 120-(N-1). Alternatively, two center orifices 120-1 and 120-1' having the same dimension may be used.

In an embodiment operating at Ka-band, a 15" circular waveguide manifold is used and includes 48 orifices (two center orifices 120-1 and 120-1') spaced a distance "D"=0.24. The circular waveguide has an inner diameter of 0.41" and operates between 25.56 and 27.56 GHz. The orifices 120-1 and 120-1' have a dimension of 0.148"×0.074" and the smallest orifices 120-N and 120-N' have a dimension of 0.06"×0.03" or greater. Shorter or longer waveguide manifolds can also be used depending on bandwidth required. As can be appreciated, the above dimensions relate to traveling wave couplers operating at approximately 26 GHz. Using scaling, operation can be obtained for other frequencies. At a minimum, operation from 16 GHz to 60 GHz is readily obtainable through scaling.

In use, a circularly polarized source transmits electromagnetic signals which are focused using the reflector network 37 and 39 into the feed horn 41. The traveling wave coupler 54 excites the $TE_{11}$ and $TM_{01}$ modes. The $TE_{11}$ mode or sum signal is coupled to the coupler 24. Microwave energy of the circular $TM_{01}$ mode is transformed into the rectangular $TE_{10}$ mode in the coupling arm 112 which is coupled to one input 70 of the hybrid 58. The hybrid 58 generates the azimuth and elevation error signals and outputs the elevation and azimuth error signals to the autotrack modulator 20 which time multiplexes the azimuth and error signals. The coupler 24 amplitude modulates the sum signal using the time multiplexed error signals and outputs the time-multiplexed, amplitude-modulated composite signal to the autotrack receiver 28. The autotrack receiver 28 demodulates the composite signal and generates the sum signal and the azimuth and error signals for use in the servoloop.

As can be appreciated, the traveling wave coupler 54 according to the invention vastly reduces weight and cost while providing performance superior to conventional traveling wave couplers. Balancing of the coupling arm 112 is not required. Weight reductions realized using the traveling wave coupler 54 can be especially important to satellite applications which must be launched into orbit. Other features and advantages will be readily apparent.

The various advantages of the present invention will become apparent to those skilled in the art after a study of the foregoing specification and following claims.

What is claimed is:

1. A traveling wave coupler for generating tracking signals from a circularly polarized microwave signal, comprising:

waveguide manifold means for exciting circular $TE_{11}$ and $TM_{01}$ modes of said circularly polarized microwave signal and including an input port, a propagation length, and an output port;

only one coupling arm waveguide including an auxiliary input port and an auxiliary output port and being aligned and connected to said waveguide manifold means along a portion of said propagation length;

coupling means located between said waveguide manifold means and said only one coupling arm waveguide for transforming microwave energy of said $TM_{01}$ mode of said circularly polarized microwave signal into a $TE_{10}$ mode in said only one coupling arm waveguide; and hybrid means having a first input coupled to said auxiliary output port of said only one coupling arm and a second input not connected to a coupling arm, said hybrid means for generating a first hybrid error signal at a first output thereof with an azimuth component and a second hybrid error signal with an elevation component 0° in-phase or 180° out-of-phase with said azimuth component.

2. The traveling wave coupler of claim 1 wherein said coupling means includes a wall, common to both said waveguide manifold means and said only one coupling arm waveguide, which has a plurality of orifices each with a center which is equally spaced from a center of an adjacent orifice.

3. The traveling wave coupler of claim 2 wherein said orifices are rectangles.

4. The traveling wave coupler of claim 3 wherein said rectangular orifices are largest at a center of said propagation length, are smallest adjacent opposing ends of said propagation length, and incrementally decrease in size from said center to said opposing ends.

5. A traveling wave coupler for generating tracking signals from a circularly polarized microwave signal, comprising:

waveguide manifold means for passing a substantially unattenuated dominant mode of said circularly polarized microwave signal from an input port along a propagation length to an output port thereof;

only one coupling arm waveguide including an auxiliary input port and an auxiliary output port wherein said only one coupling arm waveguide is aligned and connected to said waveguide manifold means along a portion of said propagation length; and coupling means located between said waveguide manifold and said only one coupling arm waveguide for transforming a difference mode of said circularly polarized microwave signal from said waveguide manifold means to said only one coupling arm waveguide, wherein said coupling means includes a wall, common to both said waveguide manifold means and said only one coupling arm waveguide, which has a plurality of orifices each with a center which is equally spaced from a center of an adjacent orifice, said orifices being largest at a center of said propagation length and incrementally decreasing in size from said center to opposing ends of said propagation length and wherein said only one coupling arm waveguide and said coupling means generate a difference signal, used to generate said tracking signals, at said auxiliary output port related to said coupled difference mode.

6. A traveling wave coupler for generating tracking signals from a circularly polarized microwave signal, comprising:

waveguide manifold means for exciting circular $TE_{11}$ and $TM_{01}$ modes of said circularly polarized microwave signal and including an input port, a propagation length, and an output port;

coupling arm waveguide including an auxiliary input port and an auxiliary output port wherein said coupling arm waveguide is aligned and connected to said waveguide manifold means along a portion of said propagation length; and coupling means located between said waveguide manifold and said coupling arm for transforming microwave energy of said $TM_{01}$ mode of said circularly polarized microwave signal into a rectangular $TE_{10}$ mode in said coupling arm waveguide, wherein said coupling means includes a wall common to both said waveguide manifold means and said coupling arm waveguide, which has a plurality of rectangular orifices each with a center which is equally spaced from a center of an adjacent orifice, and wherein said coupling arm waveguide and said coupling means generates a difference signal, used to generate said tracking signals, at said auxiliary output port related to said coupled $TE_{10}$ mode, and wherein said rectangular orifices are largest at a center of said propagation length, are smallest adjacent opposing ends of said propagation length, and incrementally decrease in size from said center to said opposing ends.

7. In an autotracking system for a circularly polarized source including a reflector network feeding a horn antenna, a servo means for orienting said reflector network, a traveling wave coupler coupled to said horn antenna for exciting a sum signal and a difference signal from said circularly polarized signal, a hybrid connected to said traveling wave coupler and having first and second inputs, an autotrack modulator coupled with said hybrid for generating a time multiplexed signal, an amplitude modulating coupler coupled with said traveling wave coupler and said autotrack modulator for amplitude modulating said sum signal with said time multiplexed signal, and an autotrack receiver connected to said modulating coupler for demodulating said amplitude-modulated and time-multiplexed signal and for generating a sum signal, an azimuth error signal, and an elevation error signal therefrom for said servo means, an improved autotracking system comprising:

a traveling wave coupler, including a waveguide and only one coupling arm, for exciting circular $TM_{01}$ and $TE_{11}$ modes in said waveguide and a $TE_{10}$ mode in said only one coupling arm wherein said only one coupling arm is coupled to said first input of said hybrid wherein said second input is not connected to a coupling arm, wherein said hybrid generates a first hybrid error signal at a first output thereof with an azimuth component and a second hybrid error signal at a second output thereof with an elevation component 0° in-phase or 180° out-of-phase with said azimuth component.

8. The improved autotracking system of claim 7 wherein said traveling wave coupler further comprises:

said waveguide including an input port, a propagation length, and an output port;

said coupling arm including an auxiliary input port and an auxiliary output port and being aligned and connected to said waveguide along a portion of said propagation length; and coupling means located between said waveguide and said coupling arm for transforming microwave energy of said $TM_{01}$ mode of said circularly polarized signal into a $TE_{10}$ mode in said coupling arm, wherein said coupling arm and said coupling means generate said difference signal, used to generate said tracking signals, at said auxiliary output port related to said coupled $TE_{10}$ mode.

9. The traveling wave coupler of claim 8 wherein said coupling means includes a wall, common to both said waveguide and said coupling arm, which has a plurality of orifices each with a center which is equally spaced from a center of an adjacent orifice.

10. The traveling wave coupler of claim 9 wherein said orifices are rectangles.

11. The traveling wave coupler of claim 10 wherein said rectangular orifices are largest at a center of said propagation length, are smallest adjacent opposing ends of raid propagation length, and incrementally decrease in size from said center to said opposing ends.

12. A traveling wave coupler for generating tracking signals from a circularly polarized microwave signal, comprising:

waveguide manifold means for exciting $TE_{11}$ and $TM_{01}$ modes of said circularly polarized microwave signal and including an input port, a propagation length, and an output port;

a coupling arm waveguide including an auxiliary input port and an auxiliary output port and being aligned and connected to said waveguide manifold means along a portion of said propagation length; and coupling means located between said waveguide manifold means and said coupling arm waveguide for transforming microwave energy of said $TM_{01}$ mode of said circularly polarized microwave signal into a $TE_{10}$ mode in said coupling arm waveguide, wherein said coupling arm waveguide and said coupling means generate a difference signal, used to generate said tracking signals, at said auxiliary output port related to said coupled $TE_{10}$ mode, wherein said coupling means includes a wall, common to both said waveguide manifold means and said coupling arm waveguide, which has a plurality of orifices each with a center which is equally spaced from a center of an adjacent orifice, and wherein said orifices are largest at a center of said propagation length, are smallest adjacent opposing ends of said propagation length, and incrementally decrease in size from said center to said opposing ends.

13. The traveling wave coupler of claim 12 wherein said orifices are rectangular.

14. A traveling wave coupler for generating tracking signals from a circularly polarized microwave signal, comprising:

waveguide manifold means for passing a substantially unattenuated dominant mode of said circularly polarized microwave signal from an input port along a propagation length to an output port thereof;

coupling arm waveguide including an auxiliary input port and an auxiliary output port, wherein said coupling arm waveguide is aligned and connected to said waveguide manifold means along a portion of said propagation length; and coupling means located between said waveguide manifold and said coupling arm for transforming a difference mode of said circularly polarized microwave signal from said waveguide manifold means to said coupling arm waveguide, wherein said coupling means includes a wall, common to both said waveguide manifold means and said coupling arm waveguide, which has a plurality of orifices each with a center which is equally spaced from a center of an adjacent orifice, wherein said coupling arm waveguide and said coupling means generate a difference signal, used to generate said tracking signals, at said auxiliary output port related to said coupled difference mode, and wherein said orifices are largest at a center of said propagation length, are smallest adjacent opposing ends of said propagation length, and incrementally decrease in size from said center to said opposing ends.

15. The traveling wave coupler of claim 14 wherein said orifices are rectangular.

16. In an autotracking system for a circularly polarized source including a reflector network feeding a horn antenna, a servo means for orienting said reflector network, a traveling wave coupler coupled to said horn antenna for exciting a sum signal and a difference signal from said circularly polarized signal, a hybrid connected to said traveling wave coupler, an autotrack modulator coupled with said hybrid for generating a time multiplexed signal, an amplitude modulating coupler coupled with said traveling wave coupler and said autotrack modulator for amplitude modulating said sum signal with said time multiplexed signal, and an autotrack receiver connected to said modulating coupler for demodulating said amplitude-modulated and time-multiplexed signal and for generating a sum signal, an azimuth error signal, and an elevation error signal therefrom for said servo means, an improved traveling wave coupler for an autotracking system comprising:

a circular waveguide for exciting circular $TM_{01}$ and $TE_{11}$ modes and including an input port, a propagation length, and an output port;

a rectangular waveguide coupling arm for exciting a rectangular $TE_{10}$ mode coupled to one input of said hybrid, with an auxiliary input port and an auxiliary output port and being aligned and connected to said waveguide along a portion of said propagation length; and coupling means located between said waveguide and said coupling arm for transforming microwave energy of said $TM_{01}$ mode of said circularly polarized signal into a $TE_{10}$ mode in said coupling arm, wherein said coupling arm and said coupling means generate said difference signal, used to generate said tracking signals, at said auxiliary output port related to said coupled $TE_{10}$ mode, wherein said coupling means includes a wall, common to both said waveguide manifold and said coupling arm, which has a plurality of orifices each with a center which is equally spaced from a center of an adjacent orifice, wherein said orifices are largest at a center of said propagation length, are smallest adjacent opposing ends of said propagation length, and incrementally decrease in size from said center to said opposing ends, and wherein said hybrid generates a first hybrid error signal at a first output thereof with an azimuth component and a second error signal at a second output thereof with an elevation component 0° in-phase or 180° out-of-phase with said azimuth component.

17. The improved traveling wave coupler for an autotracking system of claim 14 wherein said orifices are rectangular.

* * * * *